US006795051B2

(12) United States Patent
Ikeda

(10) Patent No.: US 6,795,051 B2
(45) Date of Patent: Sep. 21, 2004

(54) DRIVING CIRCUIT OF LIQUID CRYSTAL DISPLAY AND LIQUID CRYSTAL DISPLAY DRIVEN BY THE SAME CIRCUIT

(75) Inventor: Naoyasu Ikeda, Tokyo (JP)

(73) Assignee: NEC Corporation, Tokyo (JP)

( * ) Notice: Subject to any disclaimer, the term of this patent is extended or adjusted under 35 U.S.C. 154(b) by 416 days.

(21) Appl. No.: 09/861,650

(22) Filed: May 22, 2001

(65) Prior Publication Data

US 2001/0043187 A1 Nov. 22, 2001

(30) Foreign Application Priority Data

May 22, 2000 (JP) ..... 2000-149243

(51) Int. Cl.[7] ..... G09G 3/36
(52) U.S. Cl. ..... 345/100
(58) Field of Search ..... 345/100, 92, 99, 345/87, 90, 212, 213, 214, 98, 89

(56) References Cited

U.S. PATENT DOCUMENTS 4,346,333 A * 8/1982 Dagostino ..... 315/367
5,648,791 A * 7/1997 Date et al. ..... 345/89
6,157,358 A * 12/2000 Nakajima et al. ..... 345/96
6,281,870 B1 * 8/2001 Hayashi ..... 345/100
6,373,478 B1 * 4/2002 Steffensmeier ..... 345/204
6,392,630 B1 * 5/2002 Lin et al. ..... 345/98
6,437,768 B1 * 8/2002 Kubota et al. ..... 345/100
6,542,139 B1 * 4/2003 Kanno ..... 345/87
2002/0030648 A1 * 3/2002 Yamamoto et al. ..... 345/87
2003/0006955 A1 * 1/2003 Tsuchi ..... 345/92
2003/0122757 A1 * 7/2003 Bu ..... 345/87

FOREIGN PATENT DOCUMENTS

JP 1998-021332 6/1998
JP 1999-0040929 6/1999

* cited by examiner

*Primary Examiner*—Richard Hjerpe
*Assistant Examiner*—Ronald Laneau
(74) *Attorney, Agent, or Firm*—Foley & Lardner LLP

(57) ABSTRACT

A driving circuit for driving a liquid crystal display comprising a frame memory for storing image data, a DAC for converting digital data from the frame memory into analog signal, a buffer circuit for performing current amplification on the output of the DAC and supplying the same, and a logic controller for controlling the frame memory, the DAC, and outward circuits, in reply to a logic signal from the outward, in which the image data stored in the frame memory is supplied to the DAC without being converted from parallel to serial and the total number of the DACs and the buffer circuits within the driving circuit for use in driving the liquid crystal display is less than the number of the respective data bus lines.

18 Claims, 10 Drawing Sheets

DRIVING CIRCUIT OF LIQUID CRYSTAL DISPLAY AND LIQUID CRYSTAL DISPLAY DRIVEN BY THE SAME CIRCUIT

BACKGROUNDS OF THE INVENTION

1. Field of the Invention

The present invention relates to a driving circuit of a liquid crystal display (LCD) and a liquid crystal display driven by the same circuit, and more particularly to a driving circuit of a liquid crystal display for displaying images by liquid crystal pixels arranged in a matrix shape and a liquid crystal display driven by the same driving circuit.

2. Description of the Related Art

The conventional data driver IC for driving a liquid crystal display includes one having the structure shown in FIG. 9. The data driver IC 510 shown in FIG. 9 is used for an LCD of a simple matrix format with no active component disposed on a matrix-shaped liquid crystal pixel portion, which aims to reduce power consumption, by reading out image data from a frame memory 520 for image data integrated in an IC chip.

This data driver IC 510 comprises one hundred sixty data latches 530 and the same number of data latches 540 for respectively latching image data of the predetermined number of bits (for example, 160×240×2 bits) from the frame memory 520, according to a signal from the logic controller 570, one hundred and sixty decoders 550 for decoding the image data from the data latches 540, and one hundred and sixty liquid crystal driving circuits 560 for supplying the image data from the decoders 550 to one hundred sixty data bus lines. The frame memory 520 includes a RAM having the capacity of storing 160×240×2 bits, corresponding to a display for the space including two hundred and forty gate bus lines and one hundred and sixty data bus lines.

For example, in the structure of providing a frame memory outside of the data driver IC, image data is first converted into serial data so to be transferred to the data driver IC, in order to decrease the number of connection cables connecting the frame memory to the data driver IC, and then expanded into parallel data again by this data driver IC. This expanded portion needs speedy operation because the number of signal lines is decreased, thereby increasing the power consumption which is detrimental to the IC. Further, since the voltage is applied to the liquid crystals regardless of a change in display, the above speedy operation to transfer data is always required.

While, apparently access to the above data driver IC 510 means access to the frame memory 520 integrated therein, and since the data can be transferred from the frame memory 520 as it is, the serial transfer unit which increases the power consumption is not necessary.

In the case of a static image, since the image data is sequentially transferred only from the frame memory 520, access from the outside is not necessary. Thus, power consumption can be decreased in this data driver IC 510.

The simple matrix LCD, however, adopts a method of selecting a desired voltage from a plurality of voltage sources by the decoder 550, for displaying image tone. Therefore, there is a problem of increasing the number of the voltage sources according to an increase in the number of the image tones.

In order to solve the problem, the data driver IC having the structure shown in FIG. 10 is well known. This data driver IC 610 is used for an LCD of active matrix format with active components disposed on the pixel portion. This LCD comprises a plurality of data bus lines and gate bus lines extending in a way of mutually crossing at right angle which are disposed at least on one of the facing boards, a plurality of pixel electrodes provided on each intersection of the data bus line and gate bus line, and a plurality of active components (switching elements) for controlling signal supply to the respective pixel electrodes.

The data driver IC 610, which is to activate three hundred data bus lines, comprises a shift register 620 for fifty bits, a data register 630 for receiving the output of the shift register 620 and digital parallel data of six bits, a 6-bit latch circuit 640 for latching the output of the data register 630, a level shifter 650 for receiving the output from the latch circuit 640 and sending three hundred of output to DACs, three hundred digital analog converters (DAC) 660 corresponding to the respective output from the level shifter 650, and three hundred voltage follower circuits (buffer circuit) 670 corresponding to the respective output from the DACs 660.

The respective output of the voltage follower circuits 670 is supplied to three hundred data bus lines. Thus, digital data of an image is converted into analog data correspondingly to the multi-tone, by the data driver IC 610.

The DACs 660 and the voltage follower circuits 670 for the output stage of the data driver IC 610 may be disposed in the output stage of the data driver IC 510 of FIG. 9, thereby realizing the structure of the data driver IC capable of multi-tone display.

In the data driver IC, however, in which multi-tone display is enabled by providing the voltage follower circuits 670 and the like in the output stage, generally an operational amplifier is used for the voltage follower circuit 670, in consideration of the current supply capacity and the dynamic range. This operational amplifier is operated by flowing the constant current (idling current) inside the circuit, regardless of presence of input signals. The number of the operational amplifiers necessary for driving the LCD becomes the same as that of the data bus lines in any case. Therefore, according to an increase in the number of the data bus lines, the number of the DACs 660 and the voltage follower circuits 670 is increased, thereby increasing the total amount of the idling current and further increasing the power consumption.

SUMMARY OF THE INVENTION

In consideration of the above, an object of the present invention is to provide a driving circuit capable of driving a liquid crystal display at lower power consumption than that of the conventional one, and a liquid crystal display driven by the same driving circuit.

According to one aspect of the invention, a driving circuit for driving a liquid crystal display provided with a first board having a plurality of gate bus lines and data bus lines mutually crossing at right angle and a plurality of pixel electrodes connected and disposed in a matrix shape through switching elements in respective intersections of the gate bus lines and the data bus lines, a second board provided in a way of facing the pixel electrodes of the first board, and liquid crystal cells held between the first board and the second board, the driving circuit comprises a frame memory which stores image data, a digital-analog converter which converts digital data from the frame memory into analog signal, a buffer circuit which performs current amplification on output of the digital-analog converter, and a controller which controls the frame memory, the digital-analog converter, and outward circuits, in reply to a logic signal from outward, in which the total number of the digital-analog converters and the buffer circuits within the driving circuit for use in driving the liquid crystal display is less than the number of the respective data bus lines.

In the driving circuit of the liquid crystal display of the present invention, the total number of the digital analog converters and buffer circuits provided within the driving circuit can be lessened much more than the number of the data bus lines, thereby decreasing the total idling current flowing through the buffer circuits and hence decreasing the power consumption.

In the preferred construction, the image data stored in the frame memory is supplied to the digital-analog converter without being converted from parallel to serial.

In another preferred construction, the frame memory, the digital-analog converter, the buffer circuit, and the controller are formed on the same wafer.

The frame memory, the digital analog converters, the buffer circuits, and the control circuit can be formed in the same wafer, thereby making the driving circuit in compact and extremely decreasing the parasitic capacity caused by the wiring between each circuit. Therefore, it can decrease the total power consumption of the driving circuit.

In another preferred construction, the image data stored in the frame memory is supplied to the digital-analog converter without being converted from parallel to serial, and the frame memory, the digital-analog converter, the buffer circuit, and the controller are formed on the same wafer.

According to another aspect of the invention, a liquid crystal display provided with a first board having a plurality of gate bus lines and data bus lines mutually crossing at right angle and a plurality of pixel electrodes connected and disposed in a matrix shape through switching elements in respective intersections of the gate bus lines and the data bus lines, a second board provided in a way of facing the pixel electrodes of the first board, and liquid crystal cells held between the first board and the second board, the liquid crystal display comprises a driving circuit having a frame memory which stores image data, a digital-analog converter which converts digital data from the frame memory into analog signal, a buffer circuit which performs current amplification on output of the digital-analog converter, and a controller which controls the frame memory, the digital-analog converter, and outward circuits, in reply to a logic signal from outward, in which the total number of the digital-analog converters and the buffer circuits within the driving circuit for use in driving the liquid crystal display is less than the number of the respective data bus lines.

In the preferred construction, the image data stored in the frame memory of the driving circuit is supplied to the digital-analog converter without being converted from parallel to serial.

In another preferred construction, the frame memory, the digital-analog converter, the buffer circuit, and the controller of the driving circuit are formed on the same wafer.

In another preferred construction, the image data stored in the frame memory of the driving circuit is supplied to the digital-analog converter without being converted from parallel to serial, and the frame memory, the digital-analog converter, the buffer circuit, and the controller of the driving circuit are formed on the same wafer.

In another preferred construction, the liquid crystal display further comprises a first shift register for driving the gate bus line, a second shift register for driving the data bus line, and a plurality of analog switches respectively connected to the data bus lines.

The liquid crystal display of the present invention can obtain preferable liquid crystal display operation by sequentially supplying the output of the driving circuit to the data bus lines in a timesharing way, through analog switch groups connected to the second shift register.

In another preferred construction, output of the first shift register is connected to the respective gate bus lines, and control terminals of the analog switches, in every bundle of m pieces (m is the natural number), are connected to output of the second shift register, and the first and second shift registers are respectively controlled by a signal from the controller and output of the buffer circuit is connected to the analog switches.

In another preferred construction, the first shift register, the second shift register, and the analog switches are formed by a polysilicon thin film field-effect transistor at least on one of the first board and the second board.

In the preferred liquid crystal display of the present invention, the first shift register, the second shift register, and the analog switches are formed on at least one of the first board and the second board, by polysilicon thin film field-effect transistors. In this case, the liquid crystal display can be downsized, and the outward circuit can be reduced in size by forming a part of the circuit on the board, for example, on the glass board, thereby decreasing the cost of the liquid crystal display.

In another preferred construction, the first shift register, the second shift register, and the analog switches are formed by a polysilicon thin film field-effect transistor at least on one of the first board and the second board, output of the first shift register is connected to the gate bus lines, and control terminals of the analog switches, in every bundle of m pieces (m is the natural number), are connected to output of the second shift register, and the first and second shift registers are respectively controlled by a signal from the controller, and output of the buffer circuit is connected to the analog switches.

Other objects, features and advantages of the present invention will become clear from the detailed description given herebelow.

BRIEF DESCRIPTION OF THE DRAWINGS

The present invention will be understood more fully from the detailed description given herebelow and from the accompanying drawings of the preferred embodiment of the invention, which, however, should not be taken to be limitative to the invention, but are for explanation and understanding only.

In the drawings.

DESCRIPTION OF THE PREFERRED EMBODIMENT

The preferred embodiment of the present invention will be discussed hereinafter in detail with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to unnecessary obscure the present invention.

Figure 1:
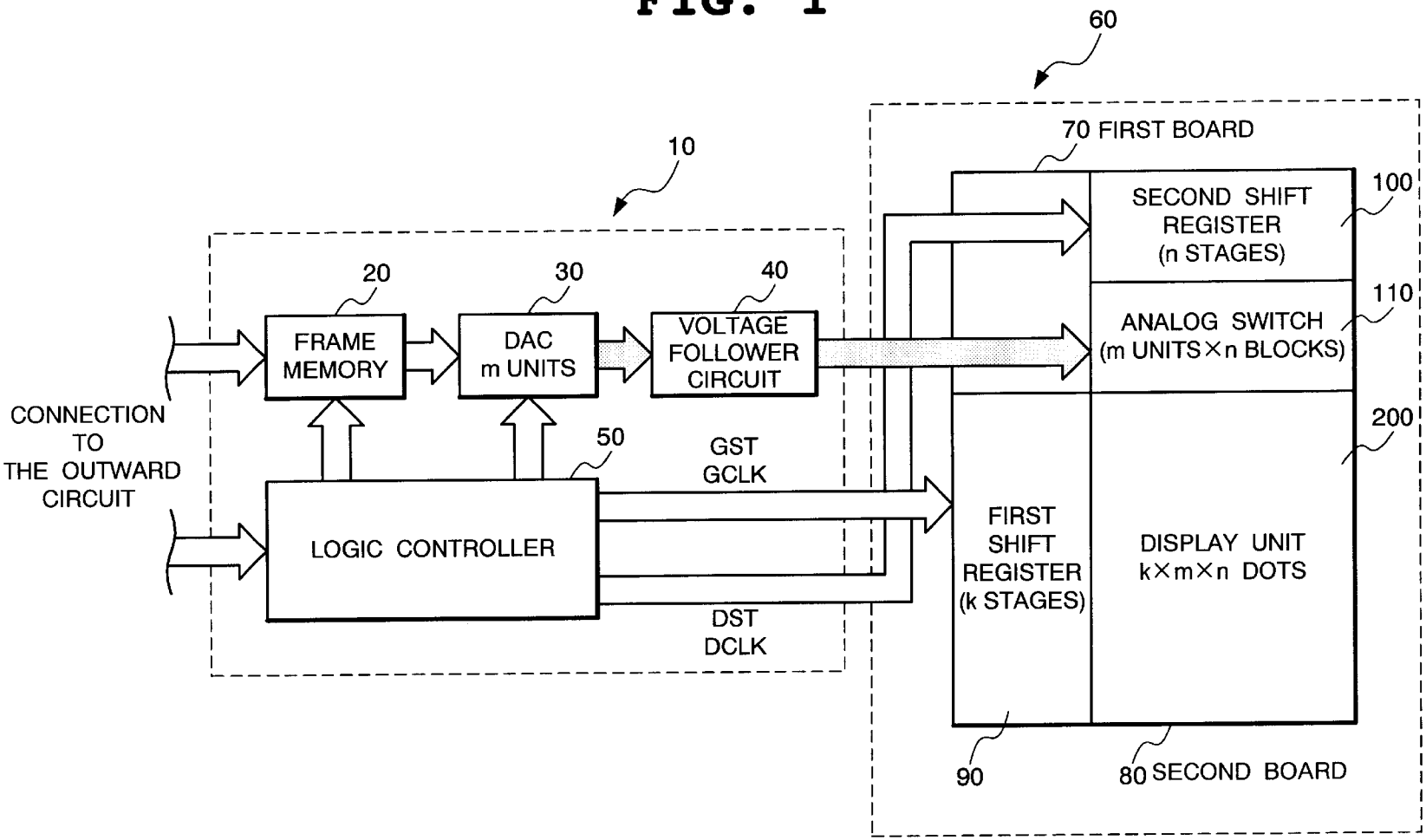
FIG. 1 is a block diagram showing the whole structure of a driving circuit and a liquid crystal display according to one embodiment of the present invention.

FIG. 1 is a block diagram showing the whole structure of a driving circuit and a liquid crystal display driven by this driving circuit according to one embodiment of the present invention.

In FIG. 1, the reference numeral 10 designates a driving circuit (data driver IC). This driving circuit 10 includes a frame memory 20, a DAC 30, a buffer circuit (voltage follower circuit) 40, and a logic controller 50. These components are formed in the same wafer, and the driving circuit 10 is formed in compact as a single IC chip.

The frame memory 20 stores parallel image data transferred from the outside and supplies this image data to the DAC 30, without converting the parallel data into serial. The DAC 30 is to convert the digital data (image data) supplied from the frame memory 20 into analog voltage (signal), and this embodiment is provided with m pieces of the DACs (m is the natural number). The buffer circuit 40 is to perform current amplification on the analog voltage from the DAC 30 (voltage amplification rate, first time) and supply it to a data bus line 130 through an analog switch 110, and it is provided for the number of m corresponding to the respective DACs 30. In reply to a control signal (logic signal) entered from the outside, the logic controller 50 respectively controls the frame memory 20 and the DACs 30 within the driving circuit 10, and circuits (outward circuits) on the side of a liquid crystal panel 60.

As mentioned above, since m pieces of the DACs 30 and m pieces of the buffer circuits 40 are respectively provided, m analog voltages (V1 to Vm) are simultaneously supplied from the driving circuit 10 to the outward. A plurality of control signals (GST, GCLK, DST, DCLK) are supplied from the logic controller 50.

The reference numeral 60 of FIG. 1 indicates a liquid crystal panel (liquid crystal display) provided on a board. The liquid crystal display 60 comprises a first shift register 90 for driving a gate bus line, a second shift register 100 for driving a data bus line, an analog switch 110, and a display unit 200.

The first shift register 90 is formed in k stages and the second shift register 100 is formed in n stages. The display unit 200 has liquid crystal cells, k×m×n dots. The analog switch 110 is divided into n blocks respectively consisting of m pieces of analog switches. The m pieces of analog switches 110 in every block are all turned on in reply to driving signals DOUT supplied from the corresponding stages of the second shift register 100. Here, k and n are the natural number like m.

In the display unit 200, liquid crystals are charged between facing first board 70 and second board 80, and data bus lines and gate bus lines extending in a way of mutually crossing at right angle, a plurality of pixel electrodes connected to each intersection of the both bus lines, and a plurality of switching elements for controlling supply of signals to the respective pixel electrodes are disposed on at least one of the boards 70 and 80. The respective switching elements are formed by polysilicon thin film field-effect transistor (hereinafter, referred to as a polysilicon TFT).

The first shift register 90 is formed on the first board 70 by using a polysilicon TFT, in order to drive the gate bus lines and the second shift register 100 is formed on the first board 70 by using a polysilicon TFT, in order to drive the analog switches 110. The analog switch 110 selectively supplies analog voltage (write voltage) output from the buffer circuit 40 to the data bus line.

Figure 2:
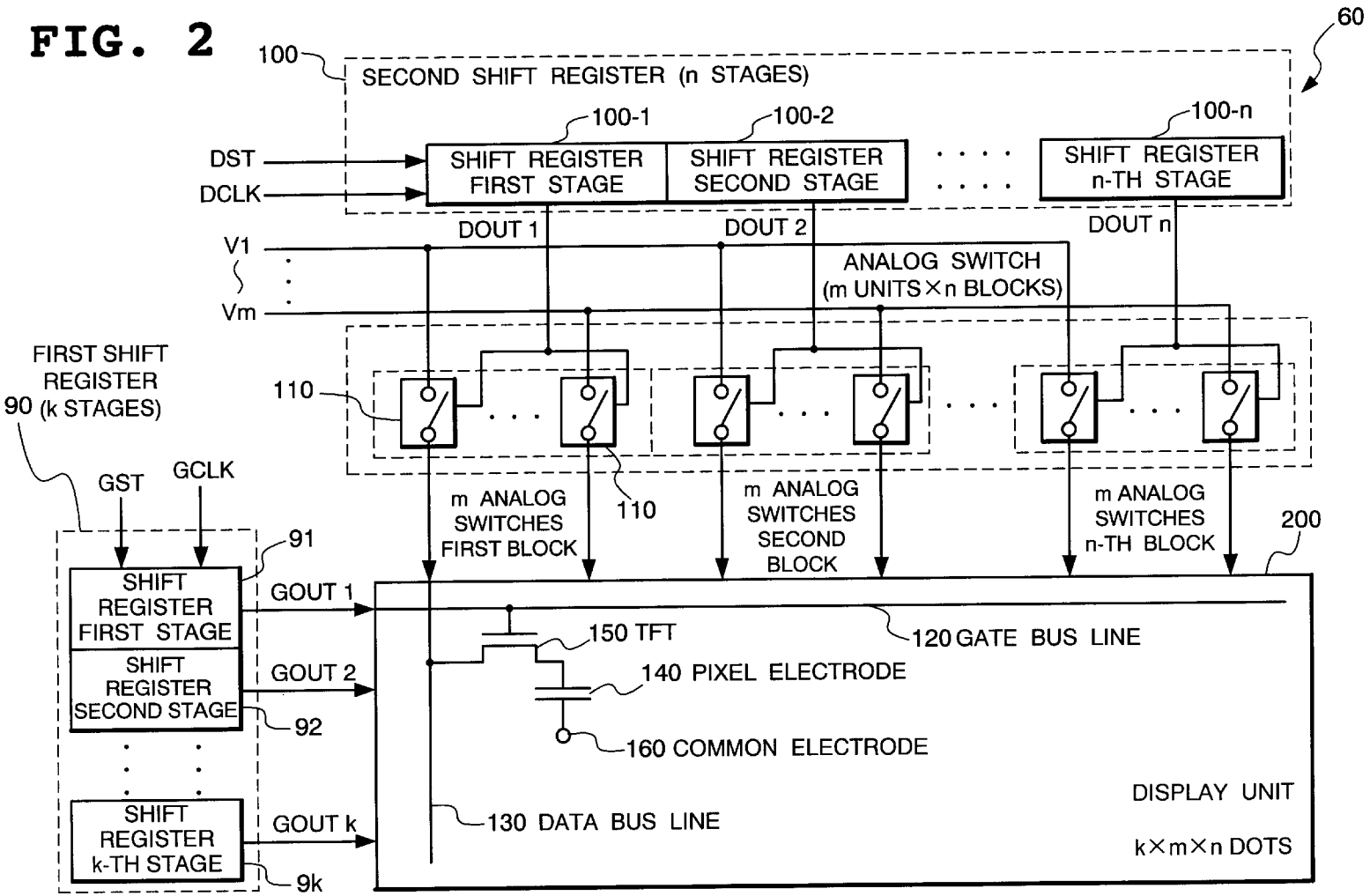
FIG. 2 is a block diagram showing the detailed structure of FIG. 1.

FIG. 2 is a block diagram showing the detailed structure shown in FIG. 1. The display unit 200 has a plurality of gate bus lines 120 and data bus lines 130 respectively extending in a matrix shape on the board. Each intersection of the bus lines 120 and 130 has a pixel electrode (electrode capacity) 140 having two electrodes and a TFT 150 whose gate electrode is connected to the gate bus line 120, drain electrode is connected to the data bus line 130, and source electrode is connected to the pixel electrode 140, so as to apply a driving voltage on liquid crystals.

A common electrode 160 is further connected to the pixel electrode 140. When the corresponding gate bus line 120 is selected, the TFT 150 supplies the voltage applied on the data bus line 130, to the pixel electrode 140.

The GST and GCLK in FIG. 2 respectively indicate a start pulse for starting the operation of the first shift register 90 and a clock signal for defining its operation speed, and the DST and DCLK respectively indicate a start pulse for starting the operation of the second shift register 100 and a clock signal for defining its operation speed. The GOUT1 to GOUTk respectively indicate select signals to be supplied from the respective stages 91 to **9*k* of the first shift register 90, and the DOUT1 to DOUTn respectively indicate driving signals to be supplied from the respective stages 100-1 to 100-*n* of the second shift register 100**.

In FIG. 2, although only one set of the gate bus line 120 and the data bus line 130 is described for the sake of convenience, actually the respective gate bus lines 120 are connected to the respective select signals GOUT2 to GOUTk as well as the select signal GOUT1, the respective data bus lines 130 are connected to the output of the respective analog switches 110, and the respective intersections are provided with the respective pixel electrodes 140 and TFTs 150.

Figure 3:
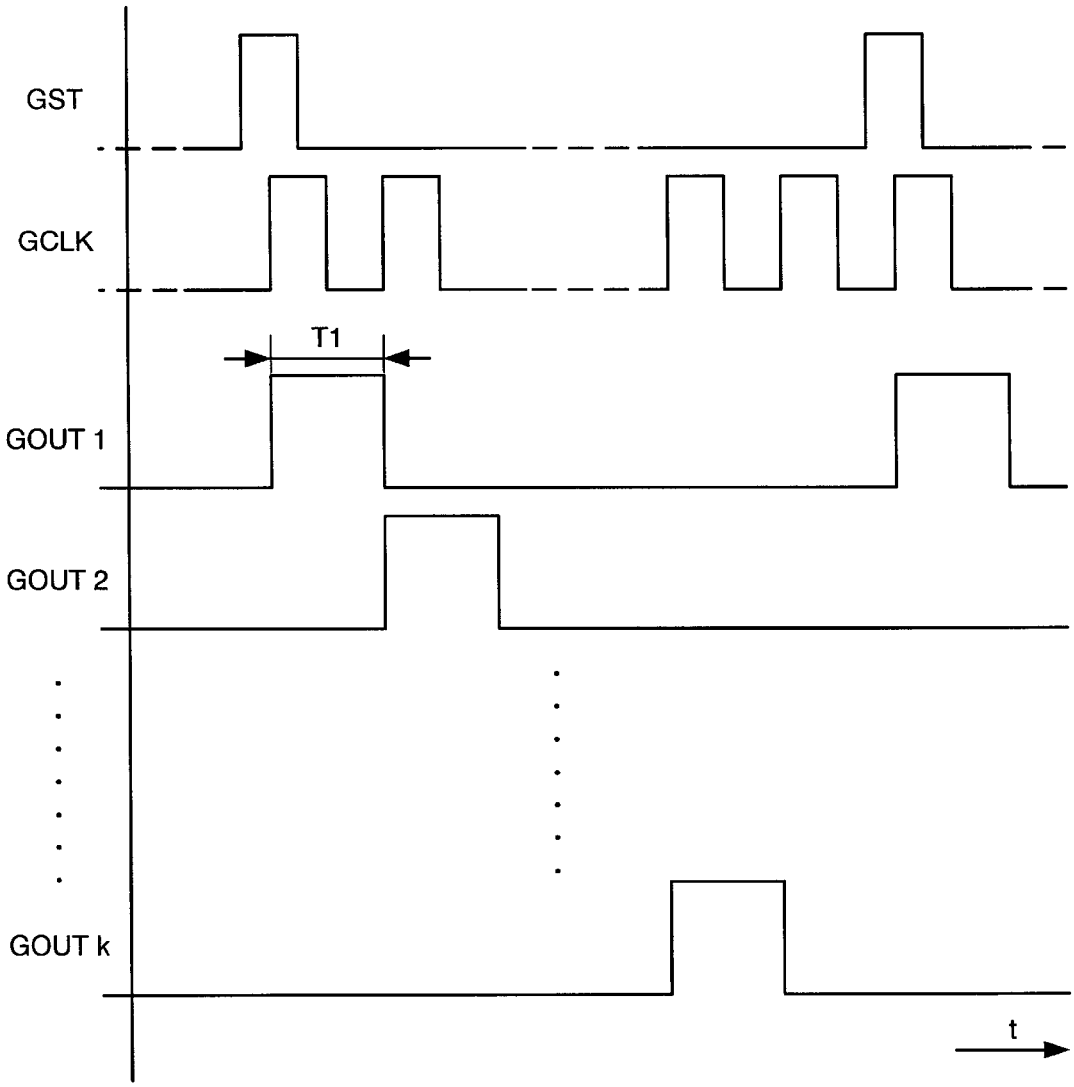
FIG. 3 is a timing chart showing each signal on the side of the first shift register according to the embodiment.
Figure 4:
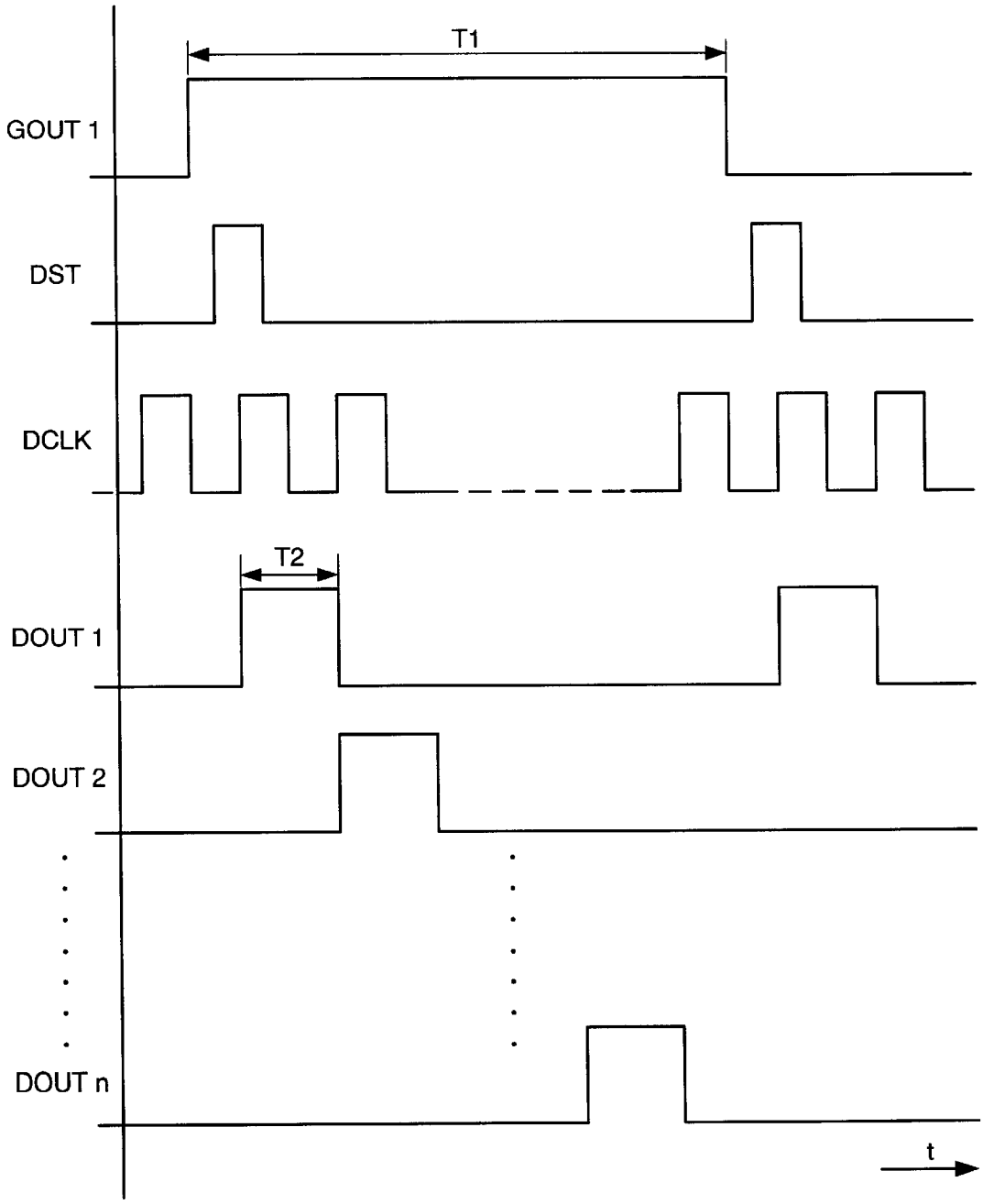
FIG. 4 is a timing chart showing each signal mainly on the side of the second shift register according to the embodiment.

The operation of the liquid crystal display according to the driving circuit relative to this embodiment will be described with reference to FIGS. 2 to 4. FIG. 3 shows a timing chart of each signal on the side of the first shift register 90, and FIG. 4 shows a timing chart of each signal mainly on the side of the second shift register 100.

As illustrated in FIG. 3, when a start pulse GST from the logic controller 50 of the driving circuit 10 (FIG. 1) is supplied to the first shift register 90, a clock signal GCLK starts to supply. In synchronization with the rising edge of the first clock signal GCLK, the select signal GOUT1 is supplied from the first stage of the first shift register 91 to the first gate bus line 120, and the TFTs 150 connected to this gate bus line 120 are all turned on (selected). The select signal GOUT1 goes down in synchronization with the rising edge of the second clock signal GCLK.

Further, in synchronization with the rising edge of the second clock signal GCLK, the select signal GOUT2 of the same pulse width is supplied from the second stage of the first shift register 92 to the next gate bus line 120, and similarly the TFTs 150 connected to this gate bus line 120 are all selected. Hereinafter, the select signals GOUT3 to GOUTk are respectively supplied to the corresponding gate bus lines 120 from the third stage 93 to the k-th stage of the first shift register 90. The select signal GOUTk is supplied and first writing is finished. Thereafter, a start pulse GST rises up again at a predetermined timing and the output of the select signals GOUT1 to GOUTk will be repeated.

Assume that each output period of the first shift register 90 is defined as T1. For example, in the period T1 when the select signal GOUT1 is supplied, the respective TFTs 150 connected to the corresponding gate bus line 120 are all turned on. At this time, as illustrated in FIG. 4, since the start pulse DST is supplied form the logic controller 50 (FIG. 1) just after the rising time of the select signal GOUT1, the driving signal DOUT1 of the output period T2 is supplied from the first stage 100-1 of the second shift register 100 in synchronization with the clock signal DCLK supplied in response to the first start pulse GST in FIG. 3.

At this time, the driving signal DOUT1 is supplied to m pieces of analog switches 110 in the first block, and m pieces of analog switches 110 in this block are all turned on (selected). The analog voltages V1 to Vm from the buffer circuit 40 are supplied to m pieces of data bus lines 130, through the respective analog switches 110 of the first block in reply to the driving signal DOUT1. The analog voltages V1 to Vm applied on the respective data bus lines 130 are supplied to the respective pixel electrodes 140 through the TFTs 150 so to activate the liquid crystals.

Similarly, in the period until rising up of the second start pulse DST (output period T1), the driving signals DOUT2 to DOUTn are sequentially supplied from the second stage 100-2 to the n-th stage **100-*n* of the second shift register 100. In this case, the driving signal DOUT2 turns on all the analog switches 110 in the second block, and the analog voltages V1 to Vm are supplied to the corresponding data bus lines 130 through the respective analog switches 110**.

The same processing will be continuously performed, and every time the analog switches 110 of every m piece in the third block, . . . , the n-th block are sequentially turned on, the analog voltages V1 to Vm are supplied to the m pieces of data bus lines 130. Thus, the writing into each pixel electrode 140 corresponding to the first gate bus line 120 selected by the select signal GOUT1 is finished.

The first writing into all the pixel electrodes 140 in the display unit 200 will be finished by repeating the same processing as for the GOUT 2, . . . , GOUTk.

In the embodiment, the driving circuit 10 comprises the frame memory 20 for storing image data, the DACs 30 for converting the digital data from the frame memory 20 into analog signals, the buffer circuits 40 for performing current amplification on the output of the DACs 30 and supplying the same, and the logic controller 50 (controlling circuit) for controlling the frame memory 20, the DACs 30, and the circuits on the side of the liquid crystal panel 60 (outward circuits) in reply to a logic signal from outward. The image data stored in the frame memory 20 is supplied to the DACs 30 without converting the data from parallel to serial, and the total number of the DACs 30 and the buffer circuits 40 within the driving circuit 10 used in driving the liquid crystal display 60 is less than the number of the data bus lines 130.

Since the embodiment is designed in that the total number of the buffer circuits 40 and the DACs 30 in the output stage which occupies a large amount of the whole power consumption of the driving circuit 10 is much less than the number of the data bus lines 130 and that the voltage writing is performed by sequential connection to the respective data bus lines 130 in a timesharing way, it is possible to decrease the total of the idling current flowing in the buffer circuits 40, so to reduce the total power consumption, and decrease the power consumption in the liquid crystal display 60 of active matrix type.

Although the embodiment has been described by way of the example such as directly forming the first and second shift registers 90 and 100 and the analog switches 110 divided into every m pieces for every block, on the first board 70 using the polysilicon TFT, the present invention is not restricted to this example. Namely, a circuit performing the same operation may be formed on the first board 70 by a single crystal silicon, or separately, an IC performing the same operation may be respectively connected to a gate bus line and a data bus line. Even this structure can perform the same operation without losing the quality of low power consumption, that is the characteristic of the present invention.

Although the embodiment has been described by using the example of directly connecting the frame memory 20 to the DAC 30, the present invention is not restricted to this. The buffer circuit may be interposed between the frame memory 20 and the DAC 30 connectively, once the image data is temporarily stored in this buffer circuit, and then the buffer circuit may supply the data to the DAC 30. Also in this case, the same effect as mentioned above can be obtained.

Figure 5:
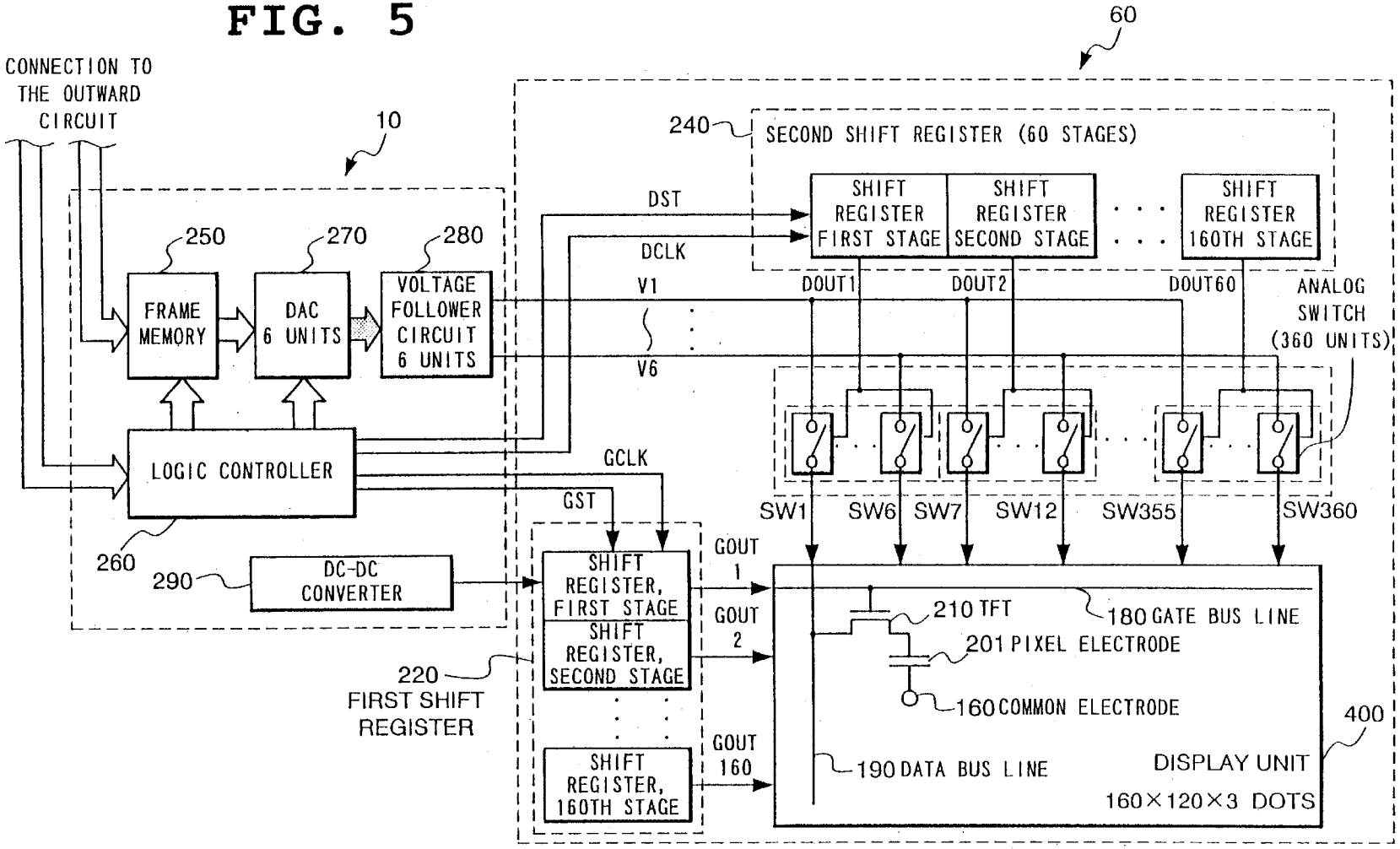
FIG. 5 is a block diagram showing the whole structure of a liquid crystal display and the driving circuit in a concrete example of the present invention.

This time, a concrete example of the embodiment will be described in detail. FIG. 5 is a block diagram showing the case of adopting the present invention to an active matrix typed LCD of 160×120×3 (RGB) dots, in which the reference numeral 60 indicates a liquid crystal panel (liquid crystal display) arranged on a glass board.

The driving circuit 10 for driving the liquid crystal display 60 comprises a frame memory 250 having the capacity, at least 120×160×3×6 bits, for storing the image data, and six DACS 270 for converting the digital data from the frame memory 250 into analog voltage. The driving circuit 10 further comprises a logic controller 260 for respectively controlling the frame memory 250, the DACs 270, shift registers 220 and 240, six buffer circuits (voltage follower circuits) 280 working as a current amplifier when supplying the analog voltages from the DACs 270 to data bus lines 190 through the analog switches SW, and a DC-DC converter 290 for generating the on-voltage of a gate.

The display unit 400 in the liquid crystal display 60 includes a plurality of gate bus lines 180 and data bus lines 190 extending in a matrix shape. In the display unit 400, a pixel electrode (electrode capacity) 201 having two electrodes formed through liquid crystal and a TFT 210 for supplying analog voltage applied on the data bus lines 190 when the gate bus line 180 is selected, to the electrode capacity 201, are provided in each intersection of the gate bus line 180 and the data bus line 190.

On the glass board, provided are a first shift register 220 consisting of one hundred and sixty stages for sequentially selecting one hundred and sixty gate bus lines 180, analog switches SW1 to SW360 consisting of three hundred and sixty (120×3) totally, sixty sets for every six blocks, and a second shift register 240 consisting of sixty stages (360/6) for respectively giving driving signals to the respective blocks of the analog switches.

Figure 6:
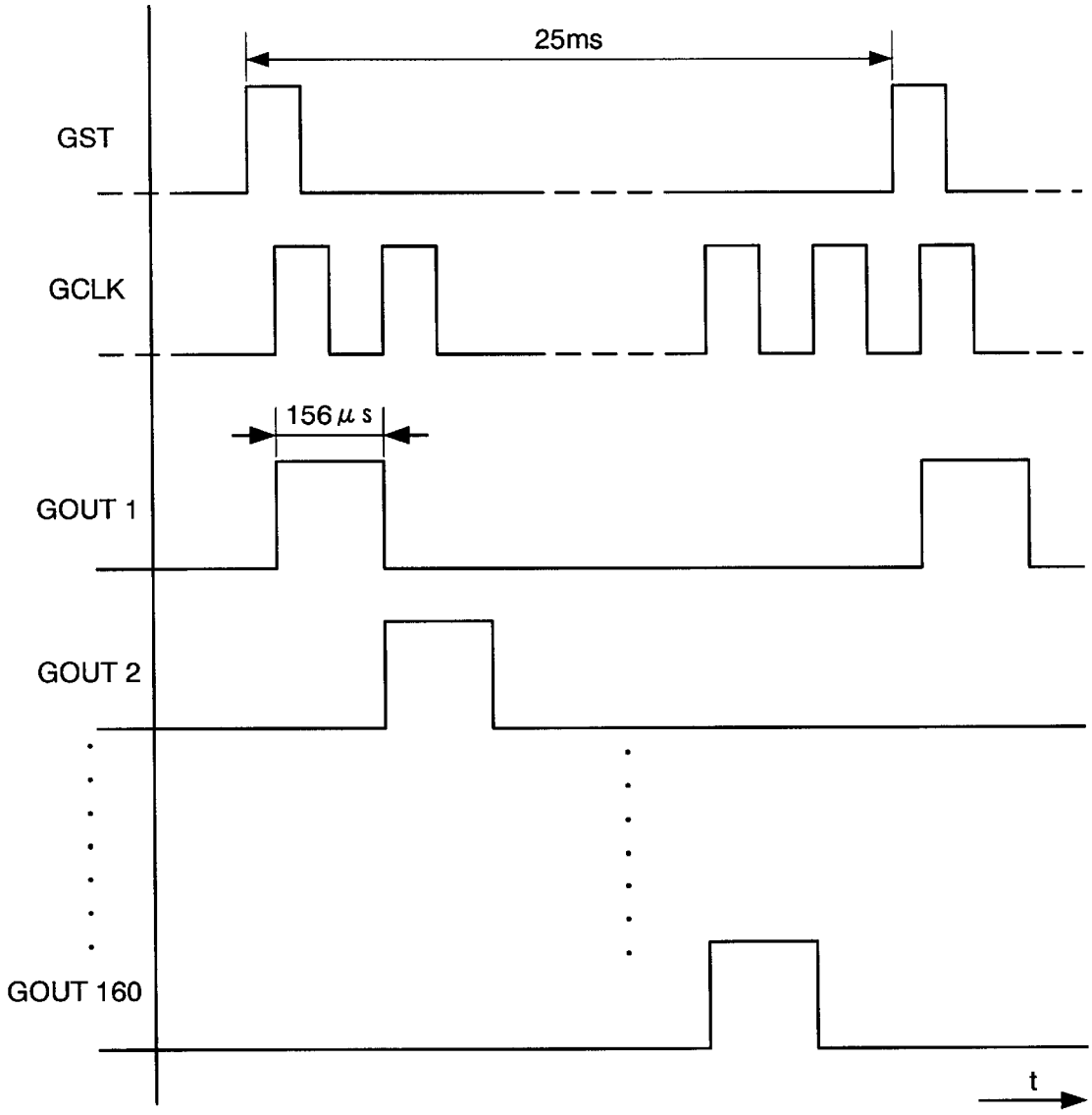
FIG. 6 is a timing chart showing each signal on the side of the first shift register according to the concrete example.
Figure 7:
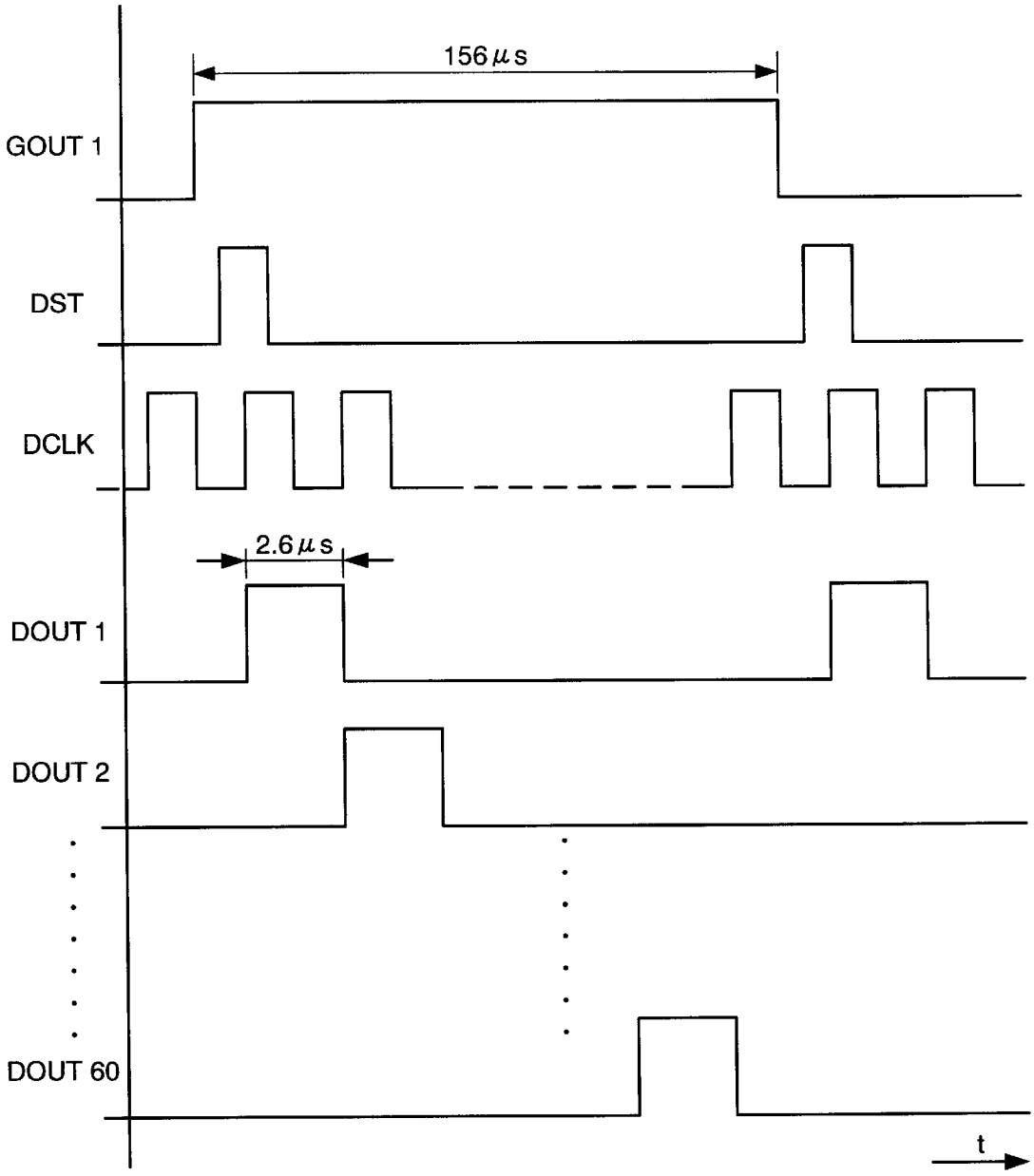
FIG. 7 is a timing chart showing each signal mainly on the side of the second shift register according to the concrete example.

The operation of the liquid crystal display according to the driving circuit of the embodiment will be described with reference to FIGS. 5 to 7. FIG. 6 shows a timing chart of each signal on the side of the first shift register 220, and FIG. 7 shows a timing chart of each signal mainly on the side of the second shift register 240. In the embodiment, the frame frequency of the display is defined as 40 Hz, and a polysilicon TFT in which the mobility of n-ch is 40 (cm2/V·s) and the mobility of p-ch is 20 (cm2/V·s) is used for a transistor on the glass board.

As illustrated in FIG. 6, when the start pulse GST is supplied to the driving circuit 10, the select signals GOUT1, GOUT2, . . . , GOUT160 will be sequentially supplied from the respective stages of the first shift register 220 in synchronization with the clock signal GCLK of the frequency 156 μs. At this time, in the period of 156 μs when the pulse of the first select signal GOUT1 is being supplied, the output from the second shift register 240 (driving signals) is sequentially supplied in the order of DOUT1, DOUT2, . . . , DOUT59 at a frequency of 2.6 μs, and DOUT60 in synchronization with the clock signal DCLK, as illustrated in FIG. 7. Therefore, the respective driving signals DOUT supplied in turn at a predetermined timing turn on all the analog switches consisting of six switches in every block.

For example, when the driving signal DOUT1 is supplied, the analog switches SW1 to SW6 in the block connected by the DOUT1 are energized, so to supply the output (analog voltages V1 to V6) from the buffer circuit 280 to the respective data bus lines 190 sequentially extending in the direction of row. When the driving signal DOUT 2 is supplied, the analog switches SW7 to SW12 in the block connected by the DOUT2 are energized, so to supply the output from the buffer circuit 280 to the data bus lines 190.

Continuously, during the output of 156 μs of the select signal GOUT1, the analog switches SW8 to SW360 connected by the output through the DOUT60 of the second shift register 240 are sequentially turned on in every block consisting of six, and the analog voltages V1 to V6 are sequentially supplied to the corresponding data bus lines 190 consisting of six through every block. Thus, three hundred and sixty data bus lines 190 are all activated.

Hereinafter, the same operation will be performed also in the period selected by the select signals GOUT2 to GOUT160, and by this repetition, a series of display on the display unit 400 will be performed.

Figure 8:
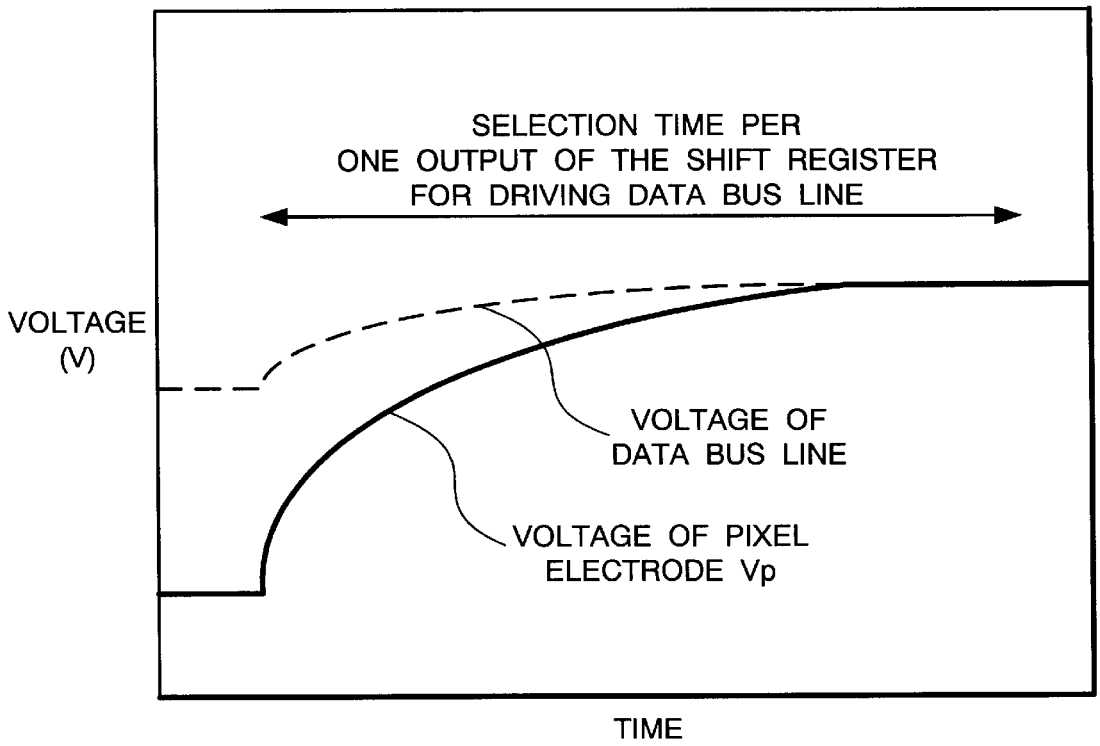
FIG. 8 is a view showing the changing state of the voltage in the data bus line and the pixel electrode at a driving time, according to the concrete example.
Figure 9:
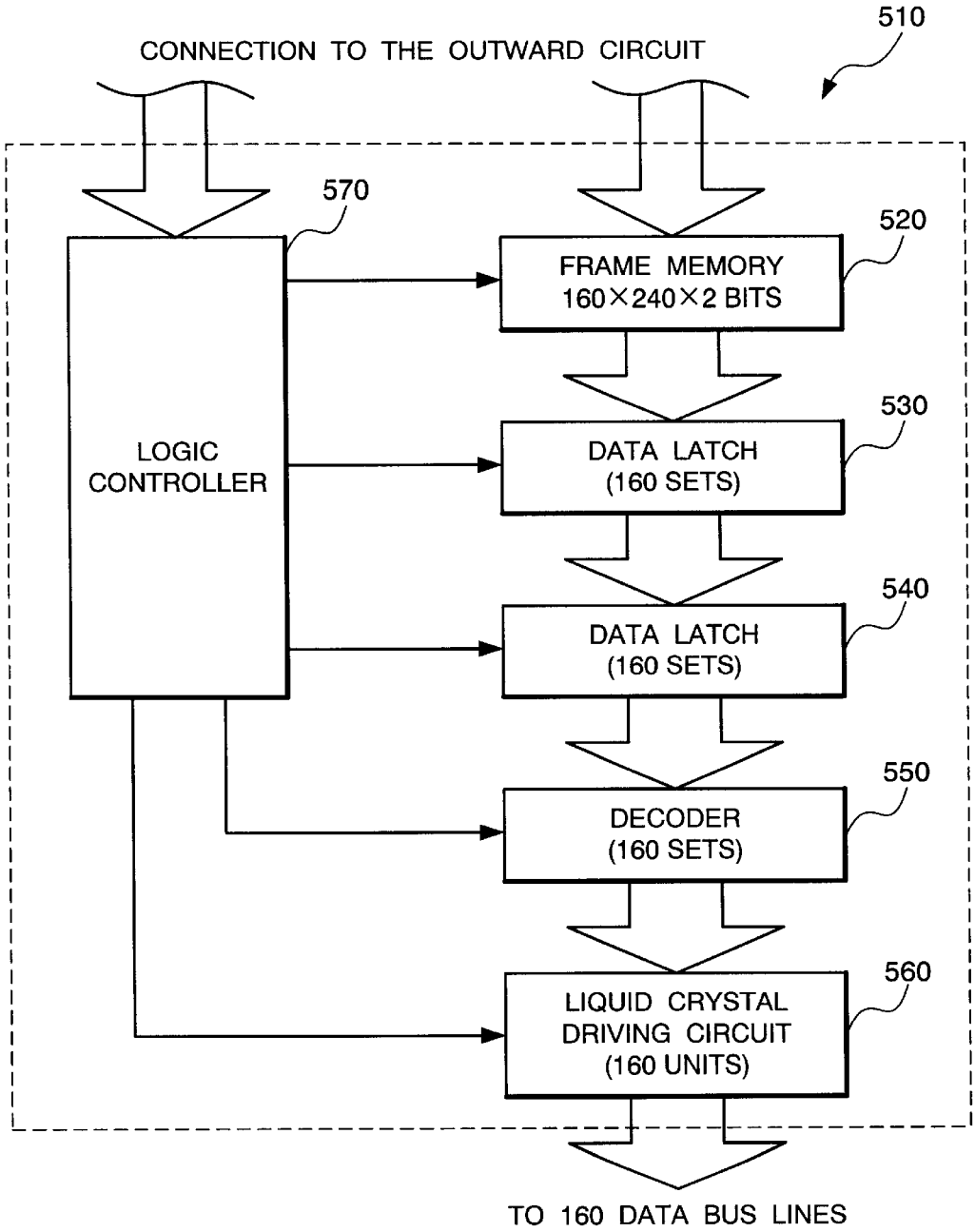
FIG. 9 (PRIOR ART)
FIG. 9 is a block diagram showing a data driver IC driving the conventional liquid crystal display.
Figure 10:
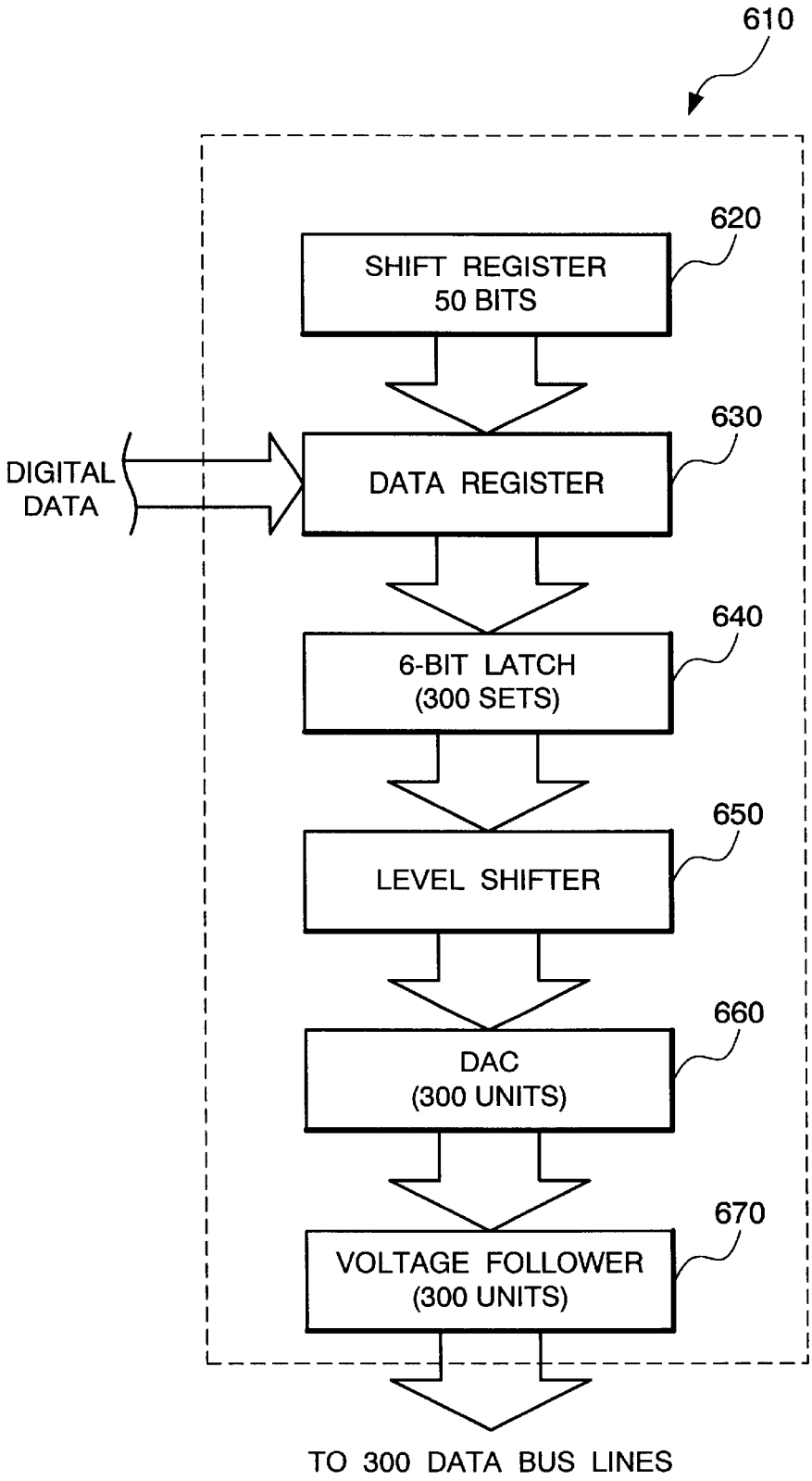
FIG. 10 (PRIOR ART)
FIG. 10 is a block diagram showing another conventional data driver IC.

FIG. 8 is a timing chart showing the relationship between the time and the voltage of each electrode on the side of the TFT 210 in the pixel electrodes 201 with the analog voltage applied there. In selecting a gate bus line 180, when the analog voltages from the data bus lines 190 corresponding to the gate bus line 180 are applied on the TFTs 210 connected to the bus line 180, each voltage Vp of the electrodes on the side of the TFT 210 becomes substantially equal to each voltage of the data bus lines 190, before the analog switch SW turns off. Therefore, even if the analog switch SW turns off, re-distribution of electric charge between parasitic capacity and pixel capacity of the data bus line 190 rarely occurs and hence the voltage of the pixel capacity never fluctuates.

Also in this embodiment, the frame memory 250, the DACs 270, the buffer circuits 280, and the logic controller 260 are formed in compact, integrally into a single IC chip, and the parasitic capacity of wiring between the respective circuits is extremely decreased, compared with the case of forming the above separately in the respective chips. Therefore, power consumption caused by this can be reduced.

As mentioned above, although the present invention has been described according to the preferred embodiments, the driving circuit of the liquid crystal display of the present invention and the liquid crystal display driven by the same circuit are not restricted to the structure of the above embodiments, but variously modified and changed driving circuit of the liquid crystal display and the liquid crystal display driven by the same circuit may be included in the scope of the present invention.

As set forth hereinabove, the present invention can obtain a driving circuit capable of driving a liquid crystal display and a liquid crystal display driven by the same driving circuit at lower power consumption than that of the conventional one.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodies within a scope encompassed and equivalents thereof with respect to the feature set out in the appended claims.

What is claimed is:

1. A driving circuit for driving a liquid crystal display provided with a first board having a plurality of gate bus lines and data bus lines mutually crossing at right angle and a plurality of pixel electrodes connected and disposed in a matrix shape through switching elements in respective intersections of the gate bus lines and the data bus lines, a second board provided in a way of facing the pixel electrodes of the first board, and liquid crystal cells held between the first board and the second board, the driving circuit comprising:

a frame memory which stores image data; a digital-analog converter which converts digital data from said frame memory into analog signal; a buffer circuit which performs current amplification on output of said digital-analog converter; and a controller which controls said frame memory, said digital-analog converter, and outward circuits, in reply to a logic signal from outward, wherein the total number of said digital-analog converters and said buffer circuits within the driving circuit for use in driving the liquid crystal display is less than the number of the respective data bus lines, wherein the image data stored in said frame memory is supplied to said digital-analog converter without being converted from parallel to serial, wherein the driving circuit further comprising a shift register for driving the data bus lines, and a plurality of analog switches respectively connected to the data bus lines, wherein the total number of said digital-analog converters is equal to m, m being an integer greater than one, wherein image data corresponding to m adjacent pixel values stored in said frame memory is respectively provided to said m digital-analog converters at the same time, and converted to m separate analog signals that are respectively provided to the data bus lines of said liquid crystal display at the same time, and wherein said controller controls the plurality of analog switches such that only m adjacent ones of said plurality of analog switches are turned on to accept the m separate analog signals output from said digital-analog converters, as current amplified by said buffer circuits, at the same time.

2. A driving circuit of a liquid crystal display as set forth in claim 1, wherein said frame memory, said digital-analog converter, said buffer circuit, and said controller are formed on the same wafer.

3. A liquid crystal display provided with a first board having a plurality of gate bus lines and data bus lines mutually crossing at right angle and a plurality of pixel electrodes connected and disposed in a matrix shape through switching elements in respective intersections of the gate bus lines and the data bus lines, a second board provided in a way of facing the pixel electrodes of the first board, and liquid crystal cells held between the first board and the second board, the liquid crystal display comprising:

a driving circuit having: a frame memory which stores image data; a digital-analog converter which converts digital data from said frame memory into analog signal; a buffer circuit which performs current amplification on output of said digital-analog converter; and a controller which controls said frame memory, said digital-analog converter, and outward circuits, in reply to a logic signal from outward, wherein the total number of said digital-analog converters and said buffer circuits within said driving circuit for use in driving the liquid crystal display is less than the number of the respective data bus lines;

a first shift register for driving the gate bus line, a second shift register for driving the data bus line, and a plurality of analog switches respectively connected to the data bus lines, wherein the total number of said digital-analog converters is equal to m, m being an integer greater than one, wherein image data corresponding to m adjacent pixel values stored in said frame memory is respectively provided to said m digital-analog converters at the same time, and converted to m separate analog signals that are respectively provided to the data bus lines of said liquid crystal display at the same time, and wherein said controller controls the plurality of analog switches such that only m adjacent ones of said plurality of analog switches are turned on to accept the m separate analog signals output from said digital-analog converters, as current amplified by said buffer circuits, at the same time.

4. A liquid crystal display as set forth in claim 3, wherein the image data stored in said frame memory of said driving circuit is supplied to said digital-analog converter without being converted from parallel to serial.

5. A liquid crystal display as set forth in claim 3, wherein said frame memory, said digital-analog converter, said buffer circuit, and said controller of said driving circuit are formed on the same wafer.

6. A liquid crystal display as set forth in claim 3, wherein the image data stored in said frame memory of said driving circuit is supplied to said digital-analog converter without being converted from parallel to serial, and wherein said frame memory, said digital-analog converter, said buffer circuit, and said controller of said driving circuit are formed on the same wafer.

7. A liquid crystal display as set forth in claim 3, wherein output of said first shift register is connected to the respective gate bus lines, and control terminals of said analog switches, in every bundle of m pieces, are connected to output of said second shift register, and wherein said first and second shift registers are respectively controlled by a signal from said controller and output of said buffer circuit is connected to said analog switches.

8. A liquid crystal display as set forth in claim 3, wherein said first shift register, said second shift register, and said analog switches are formed by a polysilicon thin film field-effect transistor at least on one of the first board and the second board.

9. A liquid crystal display as set forth in claim 3, wherein said first shift register, said second shift register, and said analog switches are formed by a polysilicon thin film field-effect transistor at least on one of the first board and the second board, wherein output of said first shift register is connected to the gate bus lines, and control terminals of said analog switches, in every bundle of in pieces, are connected to output of said second shift register, and wherein said first and second shift registers are respectively controlled by a signal from said controller, and output of said buffer circuit is connected to said analog switches.

10. A driving circuit for driving a liquid crystal display provided with a first board having a plurality of gate bus lines and data bus lines mutually crossing at right angle and a plurality of pixel electrodes connected and disposed in a matrix shape through switching elements in respective intersections of the gate bus lines and the data bus lines, a second board provided in a way of facing the pixel electrodes of the first board, and liquid crystal cells held between the first board and the second board, the driving circuit comprising:

a storing means for storing image data; a digital-analog converting means for converting digital data from said storing means into analog signal; a buffer means for performing current amplification on output of said digital-analog converting means; and a control means for controlling said storing means, said digital-analog converting means, and outward circuits, in reply to a logic signal from outward, wherein the total number of said digital-analog converting means and said buffer means within the driving circuit for use in driving the liquid crystal display is less than the number of the respective data bus lines, wherein the image data stored in said storing means is supplied to said digital-analog converting means without being converted from parallel to serial, wherein the driving circuit further comprising a shift register for driving the data bus lines, and a plurality of analog switches respectively connected to the data bus lines, wherein the total number of digital-analog converters of said digital-analog converting means is equal to m, m being an integer greater than one, wherein image data corresponding to m adjacent pixel values stored in said storing means is respectively provided to said m digital-analog converters at the same time, and converted to m separate analog signals that are respectively provided to the data bus lines of said liquid crystal display at the same time, and wherein said control means controls the plurality of analog switches such that only m adjacent ones of said plurality of analog switches are turned on to accept the m separate analog signals output from said digital-analog converters, as current amplified by said buffer means, at the same time.

11. A driving circuit of a liquid crystal display as set forth in claim 10, wherein said storing means, said digital-analog converting means, said buffer means, and said control means are formed on the same wafer.

12. A liquid crystal display provided with a first board having a plurality of gate bus lines and data bus lines mutually crossing at right angle and a plurality of pixel electrodes connected and disposed in a matrix shape through switching elements in respective intersections of the gate bus lines and the data bus lines, a second board provided in a way of facing the pixel electrodes of the first board, and liquid crystal cells held between the first board and the second board, the liquid crystal display comprising:

a driving circuit having: a storing means for storing image data; a digital-analog converting means for converting digital data from said storing means into analog signal; a buffer means for performing current amplification on output of said digital-analog converting means; and a control means for controlling said storing means, said digital-analog converting means, and outward circuits, in reply to a logic signal from outward, wherein the total number of said digital-analog converting means and said buffer means within said driving circuit for use in driving the liquid crystal display is less than the number of the respective data bus lines, a first shift registering means for driving the gate bus line, a second shift registering means for driving the data bus line, and a plurality of analog switching means respectively connected to the data bus lines, wherein the total number of digital-analog converters of said digital-analog converting means is equal to m, m being an integer greater than one, and wherein image data corresponding to m adjacent pixel values stored in said storing means is respectively provided to said m digital-analog converters at the same time, and converted to m separate analog signals that are respectively provided to the data bus lines of said liquid crystal display at the same time, and wherein said control means controls the plurality of analog switches such that only m adjacent ones of said plurality of analog switches are turned on to accept the m separate analog signals output from said digital-analog converters, as current amplified by said buffer means, at the same time.

13. A liquid crystal display as set forth in claim 12, wherein the image data stored in said storing means of said driving circuit is supplied to said digital-analog converting means without being converted from parallel to serial.

14. A liquid crystal display as set forth in claim 12, wherein said storing means, said digital-analog converting means, said buffer means, and said control means of said driving circuit are formed on the same wafer.

15. A liquid crystal display as set forth in claim 12, wherein the image data stored in said storing means of said driving circuit is supplied to said digital-analog converting means without being converted from parallel to serial, and wherein said storing means, said digital-analog converting means, said buffer means, and said control means of said driving circuit are formed on the same wafer.

16. A liquid crystal display as set forth in claim 12, wherein output of said first shift registering means is connected to the respective gate bus lines, and control terminals of said analog switching means, in every bundle of m pieces, are connected to output of said second shift registering means, and wherein said first and second shift registering means are respectively controlled by a signal from said control means and output of said buffer means is connected to said analog switching means.

17. A liquid crystal display as set forth in claim 12, wherein said first shift registering means, said second shift registering means, and said analog switching means are formed by a polysilicon thin film field-effect transistor at least on one of the first board and the second board.

18. A liquid crystal display as set forth in claim 12, wherein said first shift registering means, said second shift registering means, and said analog switching means are formed by a polysilicon thin film field-effect transistor at least on one of the first board and the second board, wherein output of said first shift registering means is connected to the gate bus lines, and control terminals of said analog switching means, in every bundle of m pieces, are connected to output of said second shift registering means, and wherein said first and second shift registering means are respectively controlled by a signal from said control means, and output of said buffer means is connected to said analog switching means.

* * * * *